United States Patent [19]

Cassia

[11] 4,018,363

[45] Apr. 19, 1977

[54] SOAP DISPENSER

[75] Inventor: Antonio Macchi Cassia, La Milan, Italy

[73] Assignee: Steiner American Corporation, Salt Lake City, Utah

[22] Filed: Oct. 6, 1975

[21] Appl. No.: 620,179

[30] Foreign Application Priority Data

Oct. 7, 1974 Italy ..... 28157/74

[52] U.S. Cl. ..... 222/80; 222/181; 222/207; 222/325

[51] Int. Cl.[2] ..... B67D 5/06

[58] Field of Search ..... 222/181, 207, 80, 383, 222/325, 180

[56] References Cited

UNITED STATES PATENTS

| | | | |
|---|---|---|---|
| 1,704,573 | 3/1929 | Matthews | 222/207 |
| 3,124,275 | 3/1964 | Lake | 222/207 X |
| 3,145,653 | 8/1964 | Lake | 222/181 X |
| 3,726,442 | 4/1973 | Davidson | 222/207 |

FOREIGN PATENTS OR APPLICATIONS

| | | | |
|---|---|---|---|
| 554,389 | 3/1958 | Canada | 222/181 |
| 1,278,449 | 10/1961 | France | 222/181 |
| 567,291 | 9/1957 | Italy | 222/80 |
| 265,642 | 7/1964 | Netherlands | 222/80 |

*Primary Examiner*—Stanley H. Tollberg
*Assistant Examiner*—Hadd Lane
*Attorney, Agent, or Firm*—Prangley, Dithmar, Vogel, Sandler & Stotland

[57] ABSTRACT

A soap dispenser, particularly for liquid soap, including a support bracket adapted to be mounted on a wall, actuating means attached to the support bracket, emitting means fixedly attached to the support bracket, a liquid soap container attachable to the emitting means, pumping means for emitting a charge of liquid soap from the emitting means, and actuating means in impositive actuating contact with the pumping means.

10 Claims, 5 Drawing Figures

SOAP DISPENSER

BACKGROUND OF THE INVENTION

The present invention relates to a liquid soap dispenser for use particularly for hygienic purposes.

There are currently known various types of liquid soap dispensers which have a common characteristic of consisting of a combination of elements, which are generally fastened to a wall by means of screws or nails. This fact, namely, the combination of elements, entails certain disadvantages of these known devices; whenever the apparatus breaks down or is damaged, it is necessary to remove the entire apparatus and to bring it to a shop for necessary repair.

Another frequently occurring disadvantage is that the handle or pushbutton for dispensing liquid soap is tightly connected to pumping means, so that the pumping means are subjected to strain or damage because of operation of the dispenser by a user. There are also instances of vandalism, and even if they are only limited, for example, to the handle or the actuating pushbutton, they also entail damage to other parts of the dispenser, so that there is need for lengthy and expensive repair.

Another disadvantage is caused by the fact that generally the pumping means for emitting liquid soap, namely, metal members and springs, are in contact with soap whereby they are subjected to clogging and frequent servicing is necessary to keep the parts clean.

SUMMARY OF THE INVENTION

Therefore, it is an object of the present invention to overcome the above disadvantages by providing a liquid soap dispenser consisting of members stationarily interconnected and so arranged that possible damage to one part does not entail damage to another part cooperating with the first part.

Another object of the invention is to provide a dispenser where any incorrect operation of the actuating handle has no ill effect on the pumping means, so that damage is confined to a minor extent.

Another object is to provide a dispenser permitting rapid on the spot replacement of the damaged or impaired parts without the need for lengthy and expensive repairs.

Still another object of the invention is to provide a dispenser consisting of a limited number of members and whose metal parts are out of contact with the liquid soap, thus avoiding the possibility of clogging during operation.

A still further object of the invention is to provide a liquid soap dispenser consisting of members which can easily be repaired by the trade, and which dispenser is also highly competitive from the purely economical point of view.

These and other objects are embodied in the dispenser particularly for liquid soap, characterized by comprising a support bracket adapted to be mounted on a wall, actuating means attached to the support bracket, emitting means fixedly attached to the support bracket, a liquid soap container attachable to the emitting means, pumping means for emitting a charge of liquid soap from the emitting means, and actuating means impositive in actuating contact with the pumping means.

Other characteristics and advantages will become apparent from the description of a preferred embodiment of a dispenser particularly for liquid soap as illustrated in an indicative, but not limiting, form in the accompanying drawings.

DESCRIPTION OF THE PREFERRED EMBODIMENTS

Figure 1:
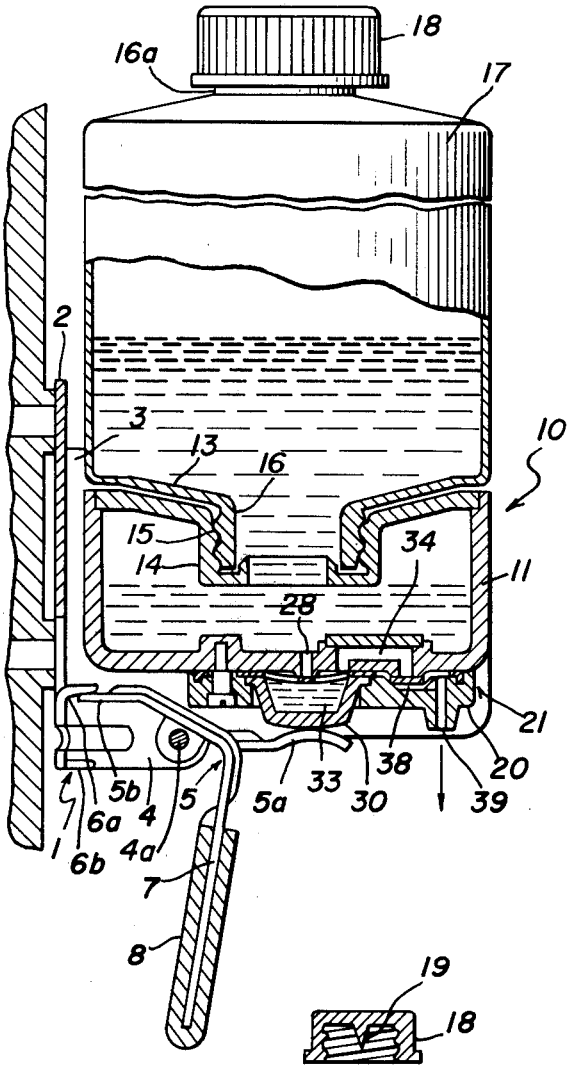
FIG. 1 is a partial longitudinal section of the entire dispenser.
Figure 2:
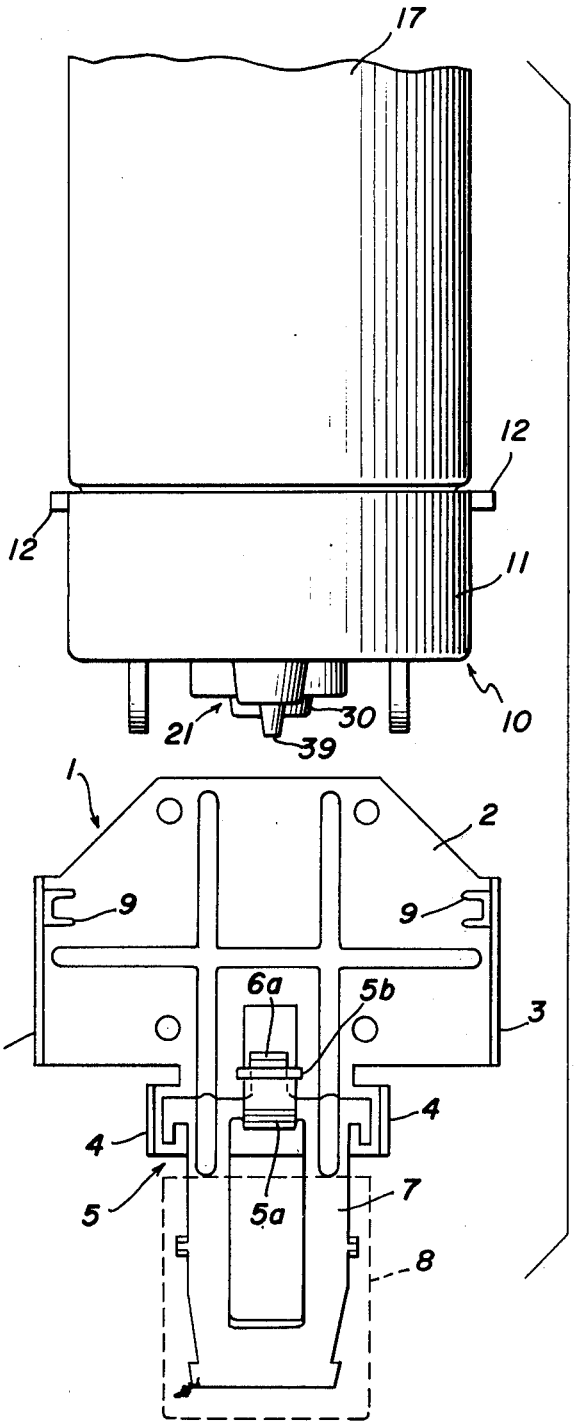
FIG. 2 is a front view of the dispenser with the emitting means and the container removed from the supporting bracket.

With reference to the above drawings, the soap dispenser of the present invention comprises a support bracket 1 having a central portion 2 from which substantially perpendicularly extend two arms 3 facing each other; the central portion 2 is adapted to be attached to a wall by means of screws inserted in openings provided in the central portion 2. Actuating means are associated with a pair of attachments 4 extending downwardly from the central portion 2. The actuating means consist of a lever 5 pivotally connected to the attachment 4 by pivot **4*a*. Lever 5 has a front actuating end 5*a* and a run-stop end 5*b* located rearwardly and cooperating with run-stops 6*a* and 6*b* provided on said portion 2 of the supporting bracket 1; a control plate or handle 7 possibly covered with a sheath 8 extends downwardly from lever 5.**

A C-shaped guide member 9 is provided on each arm 3; guide members 9 are disposed perpendicularly to the wall to which is attached the supporting bracket 1 and face each other.

Emitting means generally indicated by 10 is mounted on said supporting bracket 2; the emitting means 10 comprises a housing 11 defining therein a supply chamber **11*a* for containing liquid soap, the chamber 11*a* preferably being of square shape and the housing 11 having two protruding flanges 12 on the opposing sides thereof, the flanges being insertable into the guide members 9 for mounting the emitting means 10 an the support bracket 2. The chamber 11*a* is covered at the top by a lid 13, which has in its central portion a well 14 extending a certain distance within the chamber 11*a* and having an orifice 14*a* therethrough centrally thereof. The well 14 is provided with a female thread 15 adapted to be engaged by the screw of mouth 16 of a liquid soap container 17; this provides communication for the fluid between container 17 and the inside of the chamber 11*a*.**

The container 17 may be of the standard type and be provided at the top with an opening, the container 17 being periodically filled with liquid soap.

Figure 5:
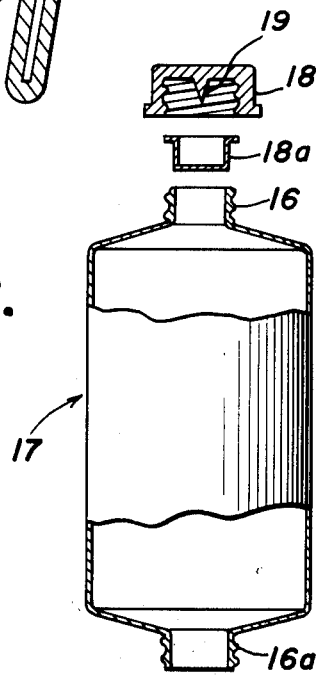
FIG. 5 shows schematically an embodiment of the container of liquid soap.
Figure 3:
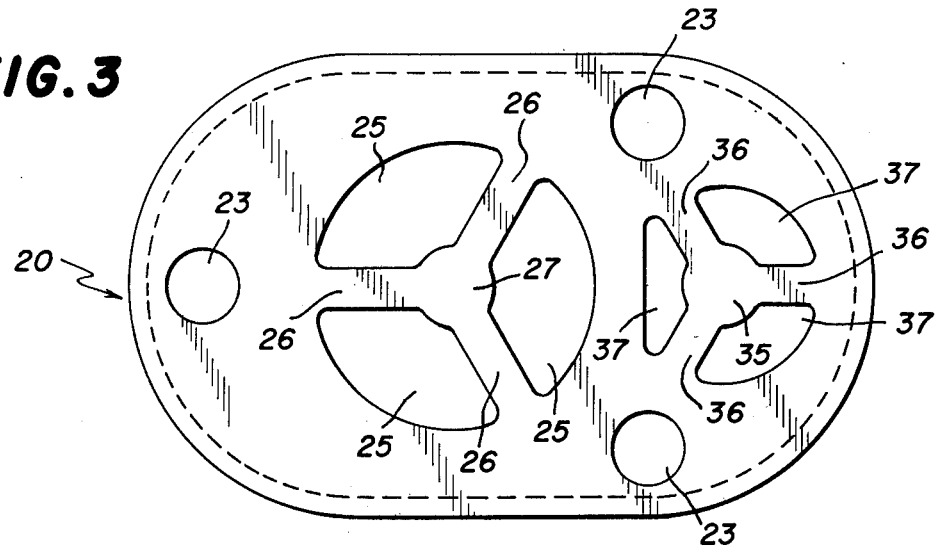
FIG. 3 is in plan view the obturator of the pumping means.
Figure 4:
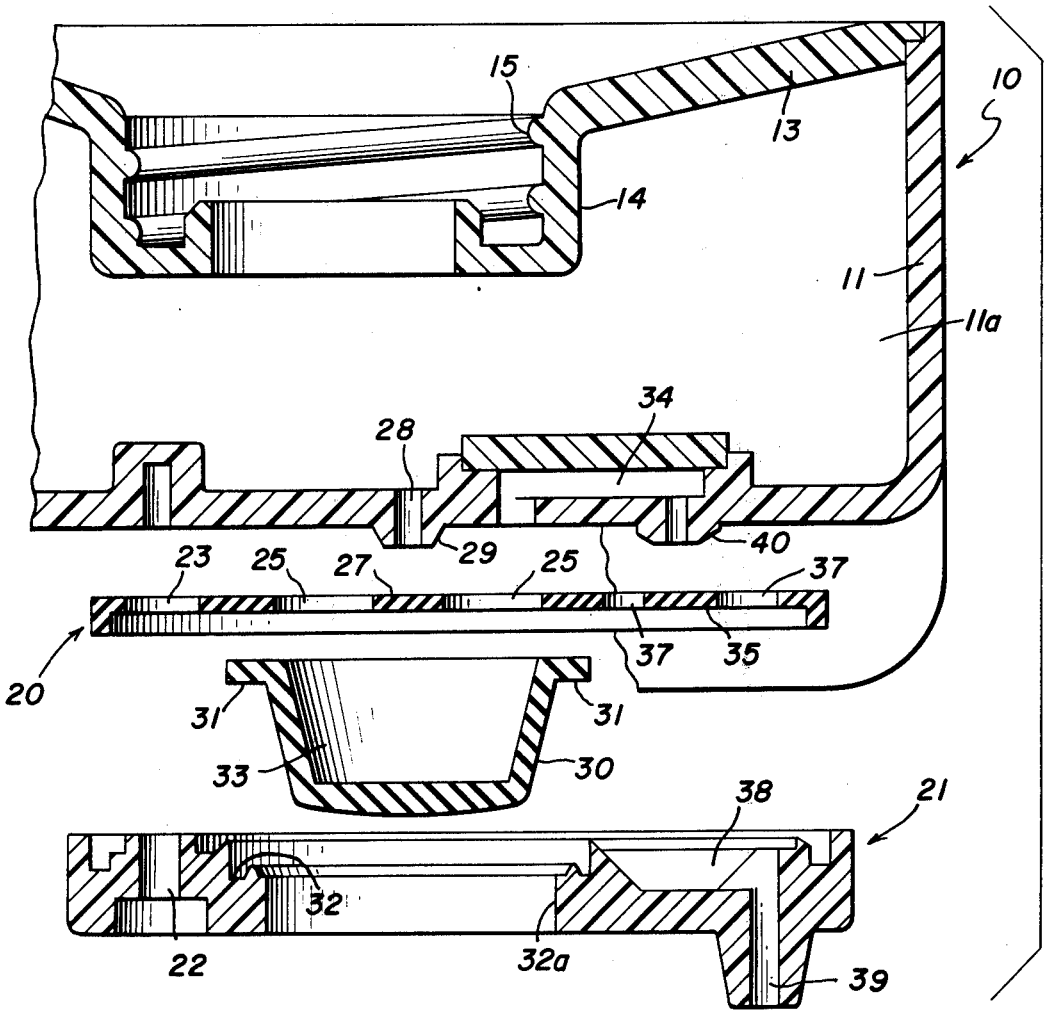
FIG. 4 is in longitudinal section and exploded view the emitting means.

Optionally, container 17 may be of the disposable type, that is, such which may be completely replaced when empty; in such case, container 17 is as shown in FIG. 5. The container 17 shown in FIG. 5 has on its two opposing bases on one side an open mouth 16 and on the other side an analogous mouth **16*a* but which is initially closed as by a membrane 16*b* for filling the container 17. The open mouth 16 is closed by a small seal 18*a* which is covered by a stopper or cap 18** adapted to be screwed around the wall of mouth 16 and which is provided with an inwardly extending tip or piercing member 19. When stopper 18 is applied to the wall of mouth 16, tip 19 cannot perforate the seal 18*a* inasmuch as the bottom of the seal is within the opening 16, but when the open mouth 16 is put on the wall of the orifice of the housing 11, the stopper 18 is screwed around the closed mouth 16*a* of container 17 until the tip 19 perforates the membrane 16*b*, creating an opening for the passage of air which permits the liquid soap to be emitted from container 17.

At a lower part of the emitting means 10 are disposed pumping means for emitting a charge of liquid soap from the emitting means 10. The pumping means comprise an obturator 20 consisting of a plate of flexible deformable material which through a pump support 21 is outwardly connected to the bottom of the housing 11 by three screws which pass through openings 22 provided in the support element 21 and three openings 23 correspondingly provided in the obturator 20 and which are screwed into the bottom of the housing 11.

The obturator 20 has a suction opening 25 within which, by means of rays or webs 26 also stamped in the body of the obturator or valve 20, is supported a suction obturator 27 positioned correspondingly to the exhaust port of a suction or aspirating conduit 28 which passes through the bottom of the housing 11; more precisely, next to the exhaust port of the conduit 28 there is provided an annular protruding flange 29 which permits holding engagement of the suction obturator 27 and the conduit 28.

Correspondingly with the suction opening 25 there is provided a downwardly extending flexible bowl 30 supported at its upper edge 31 in a groove 32 provided in the pump support element 21. It should be added that by means of a corresponding aperture 32a, bowl 30 extends downwardly from the pump support element 21.

A cavity 33 is defined within the bowl 30, and the cavity through suction openings 25 provided in the obturator 22 communicates with a supply conduit 34 provided within the bottom of the housing 11.

The exhaust port of the supply conduit 34 is controlled by a supply obturator or valve 35, which is also provided in the obturator member 20 and supported by means of rays or webs 36 in a supply opening 37 under which in the pumping support element 21 there is provided a discharge chamber 38 from which starts a fluid delivery or outlet conduit 39.

In the same way as described in respect of the suction conduit 28, around the exhaust port of supply conduit 34 there is provided an annular flange 40 which permits holding between the exhaust port of the conduit 34 and the supply obturator 35. The bowl 30 is positioned over the actuating end 5*a* of the lever 5 for actuating contact thereby.

Let us now examine the function of the liquid soap dispenser of the invention. First of all, it obviously is necessary to fill the dispenser with the liquid soap. For such purpose, if container 17 is of the standard type, it is adequate to fill through the upper opening thereof. But if container 17 is of the disposable type, the emitting means 10 are withdrawn from the supporting bracket 2, it is inverted, and its container 17 is unscrewed therefrom. It is emphasized that because of the special configuration of the chamber 11*a*, even if it is inverted, liquid soap cannot flow out, since the well 14 defines a collecting area therearound for the liquid soap possibly remaining within the chamber 11*a* and unable to escape. Once the emitting means 10 is screwed on the mouth 16 of a new container 17 by means of female thread 15 of well 14, the so-obtained entity is re-uprighted, and by means of guides 9 it is again attached to the supporting bracket 2. Then by means of stopper 18, as above described, the membrane 16*b* of the closed mouth 16*a* of the container 17 is pierced to permit the entry of air into the container 17 itself and thereby the escape therefrom of soap.

In order to emit liquid soap from the dispenser, it is sufficient for the user to actuate the control plate 7 by pulling the same; this rotates lever 5 which by the actuating end 5*a* thereof exerts squeezing pressure on bowl 30 so that a charge of liqid soap contained in cavity 33 of bowl 30 is delivered through the supply conduit 34 to the discharge chamber 38. It should be noted that the pressure exerted on the liquid soap under such conditions shifts the supply obturator 35 opening the exhaust port of supply conduit 34 and at the same time shoves the suction obturator 27 against the flange 29 preventing the amount of soap in cavity 33 from reentering chamber 11*a*. When the control plate 7 is released, the flexibility of the bowl 30 brings the lever 5 back to its initial position; during the return of the lever 5, bowl 30 exerts an aspirating action which closes the supply obturator 35 against the flange 40 and correspondingly exerts an opening action on the obturator 27, permitting the entry of new soap from the chamber 11*a* into the cavity 33 of the bowl 30, restoring the initial operational conditions.

It can be seen from the above description that the pump member is extremely simple, and above all the fact should be emphasized that no metal members are in contact with liquid soap, which feature absolutely eliminates the possibility of clogging.

It is also again emphasized that the emitting means are embodied in a unit separate from the actuating means so that any strain exerted on the lever 5 does not entail any damage of the pump means, since the lever itself actuates the bowl 30 only by impositive squeezing contact and the run-stop 6*b* is provided for limiting rotation. It is also seen that the possibly damaged parts can be directly replaced on the spot, since all main parts of the dispenser are separate units.

In conclusion, it is emphasized that the only metal parts are the supporting bracket and the lever 5, while all other parts preferably are made of plastic, which assures considerable reduction in the total cost of the dispenser.

The invention may be modified and embodied in variations within the scope of the inventive concept. Also, all described structural members may be replaced by technically equivalent members.

In practice, the used materials, dimensions, and shapes can be adapted to requirements.

What is claimed is:

1. A dispenser for liquid soap comprising a support bracket attachable to a wall, actuating means attached to said support bracket, emitting means removably mountable on said support bracket independently of said actuating means and having a fluid outlet, a liquid soap container removably attachable to said emitting means and communicating with said fluid outlet, and pumping means carried by said emitting means for emitting charges of liquid soap from said fluid outlet, said actuating means being disposed for contact with said pumping means for effecting operation thereof.

2. A dispenser for liquid soap comprising a support bracket attachable to a wall, actuating means attached to said support bracket, emitting means removably mountable on said support bracket independently of said actuating means and including a supply chamber and a discharge chamber having a fluid outlet, a liquid soap container attachable to said emitting means and communicating with said supply chamber, a flexible bowl defining a cavity therein and connected to said emitting means beneath said supply chamber, said emitting means including an aspirating conduit providing communication between said supply chamber and said bowl cavity and a discharge conduit providing communication between said bowl cavity and said discharge chamber, an aspirating valve carried by said emitting means for opening and closing said aspirating conduit, and a supply valve carried by said emitting means for opening and closing said discharge conduit, said actuating means being disposed for engagement with said flexible bowl for compression thereof, compression of said flexible bowl by said actuating means moving said aspirating valve to close said aspirating conduit and moving said supply valve to open said discharge conduit and forcing fluid from said bowl cavity through said discharge conduit to said discharge chamber and said fluid outlet, expansion of said flexible bowl upon release of said actuating means moving said supply valve to close said discharge conduit and moving said aspirating valve to open said aspirating conduit to permit flow of fluid from said supply chamber to said bowl cavity for refilling same.

3. A dispenser for liquid soap comprising a support bracket attachable to a wall, actuating means attached to said support bracket, emitting means removably mountable on said support bracket independently of said actuating means and including a supply chamber and a discharge chamber having a fluid outlet, a liquid soap container attachable to said emitting means and communicating with said supply chamber, a flexible bowl defining a cavity therein and connected to said emitting means beneath said supply chamber, said emitting means including an aspirating conduit providing communication between said supply chamber and said bowl cavity and a discharge conduit providing communication between said bowl cavity and said discharge chamber, and an integral valve member formed of flexible deformable material and carried by said emitting means and overlying said bowl cavity and said discharge chamber, said valve member including an aspirating valve portion for opening and closing said aspirating conduit and a supply valve portion for opening and closing said discharge conduit, said actuating means being disposed for engagement with said flexible bowl for compression thereof, compression of said flexible bowl by said actuating means moving said aspirating valve portion to close said aspirating conduit and moving said supply valve portion to open said discharge conduit and forcing fluid from said bowl cavity through said discharge conduit to said discharge chamber and said fluid outlet, expansion of said flexible bowl upon release of said actuating means moving said supply valve portion to close said discharge conduit and moving said aspirating valve portion to open said aspirating conduit to permit flow of fluid from said supply chamber to said bowl cavity for refilling same.

4. The dispenser set forth in claim 3, wherein said valve member includes a first plurality of apertures therethrough around said aspirating valve portion and defining spaced-apart webs of material extending radially from and supporting said aspirating valve portion, said first apertures permitting passage of fluid around said aspirating valve portion to and from said bowl cavity, said valve member including a second plurality of apertures therethrough around said supply valve portion and defining spaced-apart webs of material extending radially from and supporting said supply valve portion, said second apertures permitting flow of fluid around said supply valve portion from said discharge conduit to said discharge chamber.

5. The dispenser set forth in claim 3, and further including a first protruding flange provided around the bowl end of said aspirating conduit for facilitating holding contact of said aspirating valve portion therewith for closure thereof, and a second protruding flange provided around the discharge chamber end of said discharge conduit for facilitating contact of said supply valve portion therewith for closure thereof.

6. A dispenser for liquid soap comprising emitting means including a chamber for containing liquid soap and a cover closing the top of said chamber and a fluid outlet, said cover including in its central portion a cylindrical well extending a certain distance into said chamber and having an orifice therethrough communicating with said chamber, said well being provided with a female thread, a liquid soap container having an externally threaded mouth adapted for threaded engagement with said female thread of said well for mounting said container on said cover, pumping means carried by said emitting means for moving charges of liquid soap from said chamber to said fluid outlet for emission therefrom, and actuating means disposed for contact with said pumping means for effecting operation thereof.

7. A dispenser for liquid soap comprising emitting means having a fluid outlet, a disposable liquid soap container attachable to said emitting means for communication with said fluid outlet, said container including first and second mouths respectively disposed at the opposite ends thereof, a membrane closing said second mouth, a retaining seal removably disposable in said first mouth when said container has been filled with liquid soap, a cap having a piercing member extending from the inside thereof and being removably receivable over said first mouth and said retaining seal for closing said first mouth with said piercing member extending into said first mouth and out of contact with said retaining seal, said cap and said retaining seal being removable from said first mouth for permitting attachment of said container to said emitting means, said cap being receivable over said second mouth with said piercing member piercing said membrane to form an opening for the passage of air to permit the escape of liquid soap from said container through said first mouth when said container is attached to said emitting means, pumping means carried by said emitting means for emitting charges of liquid soap from said fluid outlet, and actuating means disposed for contact with said pumping means for effecting operation thereof.

8. A dispenser for liquid soap comprising a support bracket including a stop member and attachable to a wall, an actuating lever pivotally mounted on said support bracket for movement between a rest position and an actuating position, said lever including an actuating end and a stop-run end, emitting means removably mountable on said support bracket independently of said actuating means and being a fluid outlet, a liquid soap container attachable to said emitting means and communicating with said fluid outlet, and pumping means carried by said emitting means for emitting charges of liquid soap from said fluid outlet, said actuating end of said lever being disposed for engagement with said pumping means for effecting operation thereof to emit charges of liquid soap from said fluid outlet when said lever is in the actuating position thereof, said stop-run end of said lever being disposed for engagement with said stop member when said lever is in the rest position thereof for limiting movement thereof.

9. A dispenser for liquid soap comprising a support bracket attachable to a wall, actuating means attached to said support bracket, emitting means removably mountable on said support bracket independently of said actuating means and having a fluid outlet, said emitting means comprising a chamber for containing liquid soap and a cover closing the top of said chamber, said cover including in its central portion a cylindrical well extending a certain distance into said chamber and having an orifice therethrough communicating with said chamber, said well being provided with a female thread, a liquid soap container having an externally threaded mouth threadedly engageable with the female thread of said well for attaching said liquid soap container to said emitting means with said container disposed above said cover and communicating with said fluid outlet, and pumping means carried by said emitting means for emitting charges of liquid soap from said fluid outlet, said actuating means being disposed for contact with said pumping means for effecting operation thereof.

10. A dispenser for liquid soap comprising a support bracket attachable to a wall, actuating means attached to said support bracket, emitting means removably mountable on said support bracket independently of said actuating means and having a fluid outlet, a disposable liquid soap container attachable to said emitting means and communicating with said fluid outlet, said container including first and second mouths respectively disposed at the opposite ends thereof, a membrane closing said second mouth, a retaining seal removably disposable in said first mouth when said container has been filled with liquid soap, a cap having a piercing member extending from the inside thereof and being removably receivable over said first mouth and said retaining seal for closing said first mouth with said piercing member extending into said first mouth and out of contact with said retaining seal, said cap and said retaining seal being removable from said first mouth for permitting attachment of said container to said emitting means, said cap being receivable over said second mouth with said piercing member piercing said membrane to form an opening for the passage of air to permit the escape of liquid soap from said container through said first mouth when said container is attached to said emitting means, and pumping means carried by said emitting means for emitting charges of liquid soap from said fluid outlet, said actuating means being disposed for contact with said pumping means for effecting operation thereof.

* * * * *